US006446598B1

(12) United States Patent
Funke et al.

(10) Patent No.: US 6,446,598 B1
(45) Date of Patent: Sep. 10, 2002

(54) COMPRESSION BRAKE ACTUATION SYSTEM AND METHOD

(75) Inventors: Steven J. Funke, Princeville; Scott A. Leman, Eureka, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/734,455

(22) Filed: Dec. 11, 2000

(51) Int. Cl.[7] ..... F02D 13/04
(52) U.S. Cl. ..... 123/321
(58) Field of Search ..... 123/321, 322

(56) References Cited

U.S. PATENT DOCUMENTS

| | | | | |
|---|---|---|---|---|
| 5,146,890 A | | 9/1992 | Gobert et al. | |
| 5,183,018 A | * | 2/1993 | Vittorio et al. | 123/321 |
| 5,515,829 A | | 5/1996 | Wear et al. | |
| 5,564,385 A | | 10/1996 | Hakansson | |
| 5,586,531 A | | 12/1996 | Vittorio | |
| 5,626,116 A | | 5/1997 | Reedy et al. | |
| 5,724,939 A | | 3/1998 | Faletti et al. | |
| 6,014,956 A | | 1/2000 | Cowden et al. | |
| 6,085,721 A | * | 7/2000 | Dodi et al. | 123/321 |
| 6,095,115 A | * | 8/2000 | Fuchs | 123/321 |
| 6,273,057 B1 | * | 8/2001 | Schwoerer | 123/321 |
| 6,283,090 B1 | * | 9/2001 | Harmon | 123/321 |

* cited by examiner

*Primary Examiner*—Erick Solis
(74) *Attorney, Agent, or Firm*—Keith P. Roberson

(57) ABSTRACT

Compression brake systems using "back-fill" between combustion cylinders or requiring an exhaust valve to be opened twice during a braking cycle require brake actuation systems able to maintain control over the exhaust valve during different loading conditions. In a first opening event where a piston is at or near bottom dead center, pressures in the combustion cylinder are low. During a second opening event near top dead center pressures are higher. Movement of the exhaust valve is controlled by delivery of fluid to a brake actuator piston. Fluid delivery is slowed as the brake actuator piston moves to cover a first cylinder port and uncover a second cylinder port.

14 Claims, 2 Drawing Sheets

COMPRESSION BRAKE ACTUATION SYSTEM AND METHOD

TECHNICAL FIELD

The present invention relates generally to an engine retarding device for an internal combustion engine and more particularly to a method and system for compression brake actuation.

BACKGROUND ART

Compression brakes or engine retarders are used to assist and supplement wheel brakes in slowing heavy vehicles, such as tractor-trailers. Compression brakes are desirable because they help alleviate wheel brake overheating. As vehicle design and technology have advanced, hauling capacity of tractor-trailers has increased, while at the same time rolling resistance and wind resistance have decreased. Thus, there is a need for advanced engine braking systems in heavy vehicles.

Known engine compression brakes convert an internal combustion engine from a power generating unit into a power consuming air compressor. Typically, an exhaust valve located in a combustion cylinder opens when a piston in the cylinder nears a top dead center (TDC) position on a compression stroke.

In an effort to maximize braking power, some systems open the exhaust valve of each cylinder during a first opening event and a second opening event. In this manner, pressure released from a first cylinder into the exhaust manifold is used to boost the pressure of a second cylinder. Thereafter, the pressure in the second cylinder is further increased during the upstroke of the associated piston so that retarding forces are similarly increased. This mode of operation is termed "back-filling" and is disclosed in U.S. Pat. No. 5,724,939 issued to Faletti et al on Mar. 10, 1998.

During the first opening event, the piston is at or near bottom dead center (BDC). During the second opening event, the piston is at or near TDC and pressures in the cylinder typically are higher than pressures in the cylinder during the first opening event. Forces required to move the exhaust valve during the second opening event are greater than those in the first opening event. Systems are typically designed to meet the higher opening forces required in the second opening event. Operating the exhaust valve with these higher opening forces may cause an exhaust valve actuating device to impact the exhaust valve or loose contact with exhaust valve when acting against the lower opening forces present in the first opening event. Loosing contact between the exhaust valve and valve actuating device or "overshoot" reduces controllability of the valve opening events. Further, impact between the exhaust valve and valve actuating device may cause premature wear of both the valve actuating device and the valve.

Additionally, pressures in the cylinder during compression will act to push the valve towards a valve seat when opening forces on the valve are removed. Oftentimes the valve may impact the valve seat to cause further damage to both the valve and valve seat. Damage due to interactions between the valve and valve seat result in reduced pressure ratios and decreased performance and efficiency in both power modes and braking modes.

The present invention is directed to overcoming one or more of the problems as set forth above.

DISCLOSURE OF THE INVENTION

In one aspect of the present invention a compression brake actuation device includes a brake actuator cylinder having a first port and a second port. A fluid conduit is in fluid communication with the first port and the second port. A brake actuator piston is positioned in the brake actuator cylinder. The brake actuator piston has a first actuating surface and a second actuating surface. The brake actuator piston has first piston passage through adapted to fluidly connect the first port with the first actuating surface. A second piston passage through the brake actuator piston fluidly connects the second port with the second actuating surface. The brake actuator piston is movable within the brake actuator cylinder to restrict fluid communication between the first port and the first piston passage. The brake actuator piston may also restrict fluid communication between the second port and the second piston passage.

In another aspect of the present invention, a method of actuating a compression brake system includes delivering a fluid to a first actuating surface. Delivery of the fluid is slowed by movement of a brake actuator piston.

BEST MODE FOR CARRYING OUT THE INVENTION

Figure 1:
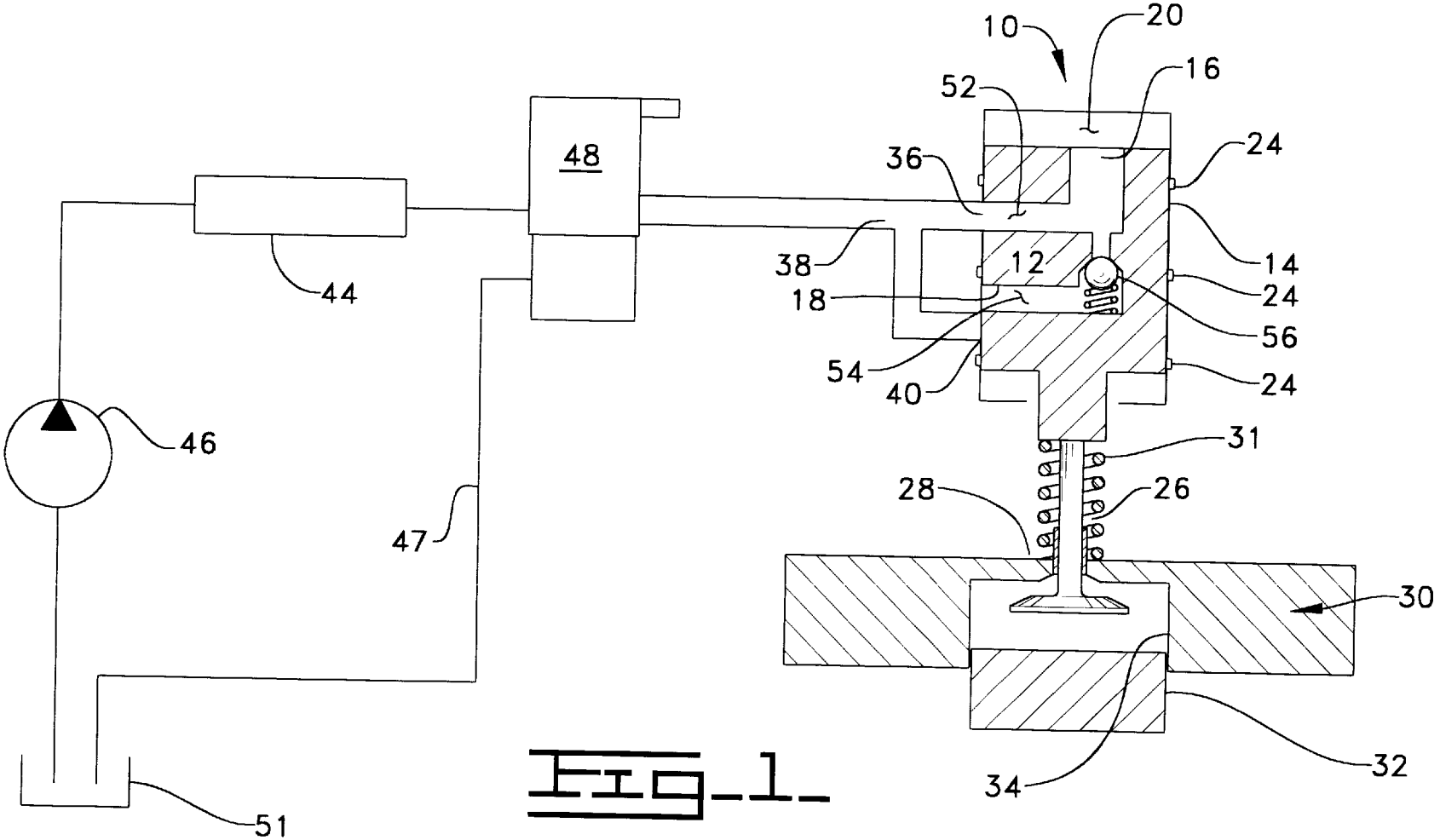
FIG. 1 is a sketch of a compression brake system incorporating the method of the present invention.

In FIG. 1 a compression brake system 10 is shown having a brake actuator piston 12 and a brake actuator cylinder 14. The brake actuator piston 12 is slidably positioned in the actuator cylinder 14. The brake actuator piston 12 has a first actuating surface 16 and a second actuating surface 18 opposite one another. The first actuating surface 16 and brake actuator cylinder 14 define an actuator volume 20. A seal 24 of any conventional design connects between the brake actuator piston 12 and the actuator cylinder 14. The brake actuator piston 12 connects with a valve 26 positioned in a port 28 of an internal combustion engine 30. In this application the valve 26 is an exhaust valve positioned in an exhaust port. A valve spring 31 connects between the engine 30 and valve 26. The engine 30 may be of any conventional design having a piston 32 moving within a combustion cylinder 34.

The brake actuator cylinder 14 also has a first cylinder port 36 positioned to allow fluid to pass from a fluid conduit 38 into the actuator volume 20 and a second cylinder port 40 positioned to allow fluid to pass from the fluid conduit 38 onto the second actuating surface 18. In this embodiment, the fluid conduit 38 connects to a fluid manifold 44 in this application a hydraulic oil line being fed by an oil pump 46. Preferably the first oil pump 46 will have variable flow rates and an internal pressure regulator as described in U.S. Pat. No. 5,515,829 issued to Wear et al on May 14, 1996. Other fluids such as water, fuel, or air may also be used. A control valve 48 is positioned in the fluid conduit 38 intermediate the fluid manifold 44 and the brake actuator cylinder 14. Any conventional valve may be used such as electronic, mechanical, hydraulic, or piezoelectric valves. For this embodiment, the control valve 48 is a electro-hydraulically actuated valve such as the upper portion of the hydraulically actuated, electronically controlled unit fuel injector as shown in U.S. Pat. No. 6,014,956 issued to Cowden et al on Jan. 18 2000. The control valve 48 also connects with a drain line 47 to return fluid to a sump 51. In this application, the fluid manifold 44 and first oil pump 46 also supply control fluid to a hydraulically actuated fuel system (not shown).

Figure 2:
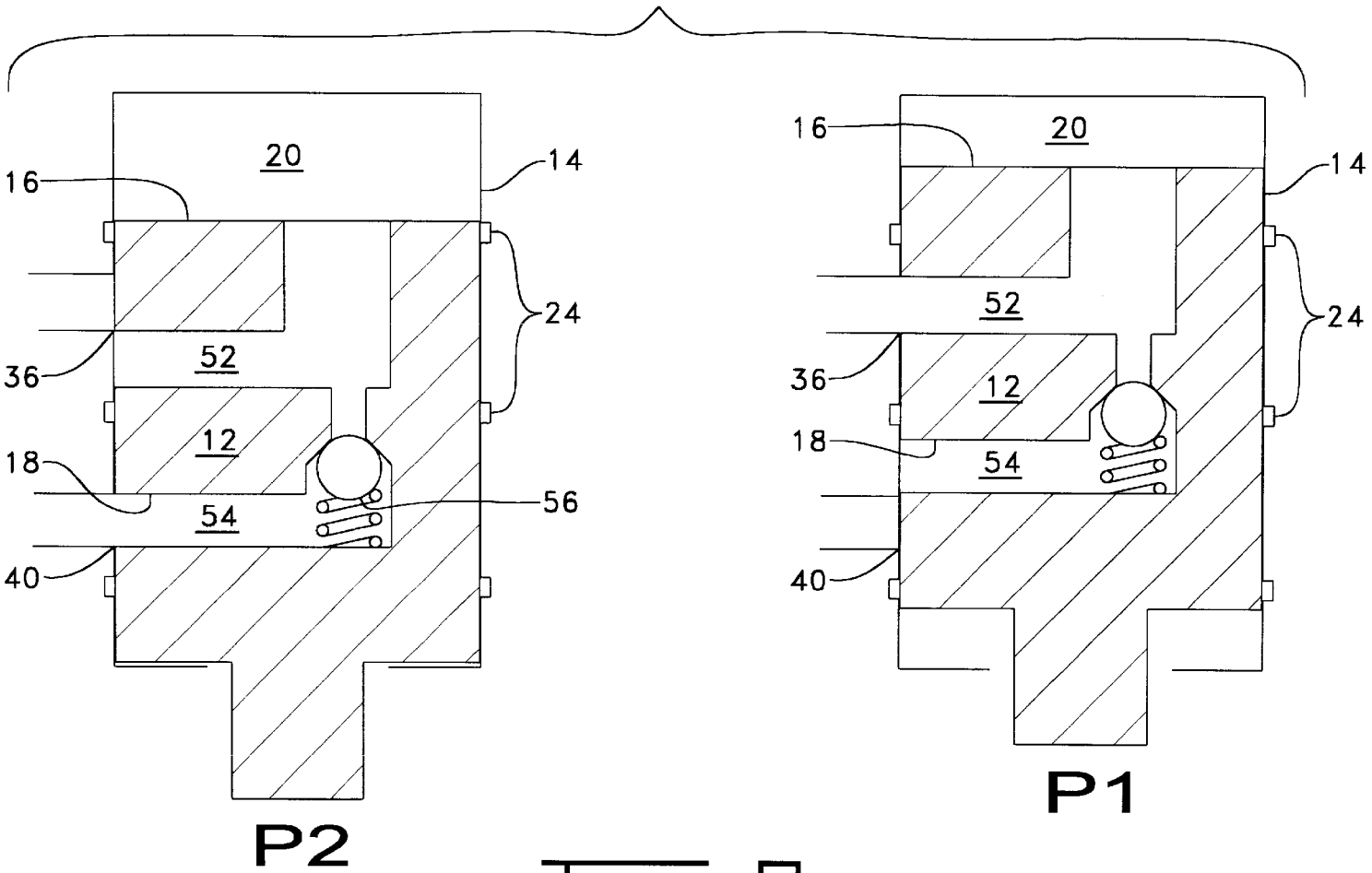
FIG. 2 is a sketch showing a brake actuator cylinder.

FIG. 2 shows the brake actuator piston 12 having a first piston passage 52 and a second piston passage 54. While the brake actuator piston 12 is in a first position P1, the first piston passage 52 connects the first cylinder port 36 to the first actuating surface 16. While the brake actuator piston 12 is in a second position P2, the second piston passage 54 connects the second cylinder port 40 with the second actuating surface 18. The first piston passage 52 and second piston passage 54 are fluidly connected. A check valve 56 is positioned intermediate the first piston passage 52 and the second piston passage 54. While FIG. 2 shows a ball type check valve, any conventional flow restricting device will also work to prevent or substantially limit flow from the second piston passage 54 to the first piston passage 52.

Industrial Applicability

The compression brake system 10 of the current invention prevents "overshoot" by reducing flow to the actuator volume 20 as the brake actuator piston 12 moves towards its second position P2. Reducing "overshoot" improves control of the brake actuation system 10 and reduces wear inherent from the break actuator piston 12 impacting the exhaust valve 26.

During a first opening event, the piston 32 is at or near BDC. Pressures in the combustion cylinder 34 at this time are relatively low. Opening the exhaust valve 26 during the first opening event requires sufficient force to compress the spring 31. During a second opening event, the piston 32 is at or near top dead center (TDC). Pressure in the combustion cylinder 34 during the second opening event is increased. The opening force for the second opening event must now overcome both force from the spring 31 along with pressure forces acting on the valve 26. Fluid in the fluid manifold 44 is generally at a predetermined pressure. The first actuating surface 16 is generally designed to produce sufficient forces, when exposed to fluid pressures in the fluid manifold 44, to open the exhaust valve 26 during the second opening event. However, the sufficient forces for the second opening event result in overshoot during the first opening event.

To actuate the compression brake system 10, the control valve 48 moves to a first position allowing fluid from the fluid manifold 44 to pass into the actuator volume 20. As fluid enters the actuator volume 20, pressure on the first actuating surface 16 moves the brake actuator piston 12 against the valve 26. The brake actuator piston covers the first cylinder port 36 as it moves toward its second position P2 and opens the second cylinder port 40. Restricting fluid to the first actuating surface 16 slows pressure increases in the actuator volume 20 and slows movement of the brake actuator piston 12.

To deactivate the compression brake system 10, the control valve 48 is moved to a second position allowing fluid to exit the brake actuator cylinder 14 through the second cylinder port 40. As the brake actuator piston 12 moves toward its first position P1, pressure in the actuator volume 20 increases. To facilitate rapid return of the brake actuator piston 12 to its first position P1, the check valve 56 opens at some predetermined pressure to reduce pressure build up in the actuator volume 20. As the brake actuator piston 12 approaches its first position P1, fluid may drain from both the first cylinder port 36 and second cylinder port 40 if pressures in the actuator volume 20 are sufficient to open the check valve 56.

Other aspects, objects, and advantages of this invention can be obtained from a study of the drawings, the disclosure, and the appended claims.

What is claimed is:

1. A compression brake actuating device for an internal combustion engine, said compression brake actuating device comprising:

a brake actuator cylinder having a first cylinder port and a second cylinder port;

a fluid conduit in fluid communication with said first cylinder port and said second cylinder port;

a brake actuator piston positioned in said brake actuator cylinder, said brake actuator piston having an actuating surface;

an actuator volume defined by said actuating and said brake actuator cylinder;

a first piston passage through said brake actuator piston, said first piston passage being adapted to fluidly connect said first cylinder port with said actuator volume; and a second piston passage through said brake actuator piston, said second piston passage being adapted to fluidly connect said second cylinder port with said actuator volume, said brake actuator piston being movable within said brake actuator cylinder to restrict fluid communication between said first cylinder port and said first piston passage, said brake actuator piston being movable within said brake actuator cylinder to restrict fluid communication between said second cylinder port and said second piston passage, said first piston passage being connected with said second piston passage.

2. The compression brake actuating device as set out in claim 1 further comprising a flow restriction device between said first piston passage and said second piston passage.

3. The compression brake actuating device as set out in claim 2 wherein said flow restriction device is a check valve, said check valve allowing fluid communication from said first piston passage to said second piston passage.

4. A compression brake system for an internal combustion engine, said compression brake system comprising:

a brake actuator cylinder having a first cylinder port and a second cylinder port;

a fluid conduit in fluid communication with said first cylinder port and said second cylinder port;

a brake actuator piston positioned in said brake actuator cylinder, said brake actuator piston having an actuating surface, said brake actuator piston being adapted to connect with a valve being adapted to restrict a port on an internal combustion engine, said brake actuator cylinder and said actuating surface defining an actuator volume;

a first piston passage through said brake actuator piston, said first piston passage being adapted to fluidly connect said first cylinder port with said actuator volume;

a second piston passage through said brake actuator piston, said second passage being adapted to fluidly connect said second cylinder port with said actuator volume, said first piston passage fluidly connecting with said second piston passage;

a fluid manifold being connected with said fluid conduit; and a control valve being positioned intermediate said brake actuator cylinder and said fluid manifold.

5. The compression brake system as set out in claim 4 further comprising a check valve between said first piston passage and said second piston passage.

6. The compression brake actuation system as set out in claim 4 wherein said fluid manifold is a hydraulic oil line.

7. The compression brake system as set out in claim 4 including a flow restriction device between said first piston passage and said second piston passage.

8. A brake actuator piston for a compression brake device in an internal combustion engine, said brake actuator piston comprising:

a first piston passage fluidly connecting with an actuating surface of the brake actuator piston; and a second piston passage fluidly connecting with said actuating surface, said first piston passage fluidly connecting with said second piston passage.

9. The brake actuator piston of claim 8 including a flow restriction device between said first piston passage and said second piston passage.

10. The brake actuator piston of claim 9 wherein said flow restriction is a check valve.

11. A method of operating a brake actuating device for an internal combustion, said method comprising:

supplying a fluid through a first piston passage to an actuator volume to move a brake actuator piston from a first position (P1) to a second position (P2);

moving said brake actuator piston from said second position (P2) toward said first position (P1); and draining said fluid through a second piston passage fluidly connected with said actuator volume.

12. The method of operating the brake actuating device of claim 11 including draining said fluid through said first piston passage.

13. The method of operating the brake actuating device of claim 11 including restricting flow from said actuator volume to said second piston passage.

14. The method of operating the brake actuating device of claim 13 wherein said restricting flow is preventing flow from said second piston passage to said first piston passage.

* * * * *